US012274385B2

(12) United States Patent
Bao et al.

(10) Patent No.: US 12,274,385 B2
(45) Date of Patent: Apr. 15, 2025

(54) WINE BOTTLE HOLDER

(71) Applicant: TEAM YTD CO., LIMITED, Hong Kong (HK)

(72) Inventors: Zhiming Bao, Hong Kong (HK); Canqiang Zhang, Hong Kong (HK)

(73) Assignee: TEAM YTD CO., LIMITED, Hong Kong (HK)

( * ) Notice: Subject to any disclaimer, the term of this patent is extended or adjusted under 35 U.S.C. 154(b) by 0 days.

(21) Appl. No.: 18/406,382

(22) Filed: Jan. 8, 2024

(65) Prior Publication Data

US 2024/0407579 A1 Dec. 12, 2024

Related U.S. Application Data

(63) Continuation-in-part of application No. 18/329,843, filed on Jun. 6, 2023, now Pat. No. 11,903,501.

(51) Int. Cl.
*A47G 23/02* (2006.01)

(52) U.S. Cl.
CPC ..... *A47G 23/0241* (2013.01)

(58) Field of Classification Search
CPC ..... A47G 23/0241; A47G 23/0309; F21V 33/0036; F21Y 2115/10; B67B 7/0405
See application file for complete search history.

(56) References Cited

U.S. PATENT DOCUMENTS 2,596,452 A * 5/1952 Wehmiller ..... G01N 21/9027 356/239.4
3,795,158 A * 3/1974 Morita ..... B67B 3/2006 81/3.32
4,836,476 A * 6/1989 Wolf ..... A47G 23/0241 362/802
5,345,844 A * 9/1994 Marsaw ..... B67B 7/182 81/3.2
6,293,170 B1 * 9/2001 Hajianpour ..... B67B 7/182 81/3.2
6,793,363 B2 * 9/2004 Jensen ..... A47G 23/0309 362/101
2003/0076672 A1 * 4/2003 Head ..... A47G 23/0309 220/605
2012/0181405 A1 * 7/2012 Zlatic ..... F16M 13/022 29/525.08
2017/0158477 A1 * 6/2017 Varme ..... B67B 7/0405
2018/0310743 A1 * 11/2018 Abukar ..... A47G 23/0241
2020/0157482 A1 * 5/2020 Levin ..... C12H 1/165

* cited by examiner

*Primary Examiner* — Ko H Chan

(57) ABSTRACT

A wine bottle holder includes a support device, a driving device and a connecting assembly. The support device configured to bear a wine bottle. The support device being formed thereon with a first mounting groove, and the first mounting groove being formed therein with a first through hole communicated with an inside of the support device. The driving device provided with a driving end, the driving device being arranged inside the support device. The connecting assembly arranged inside the first mounting groove, the driving end of the driving device passing through the first through hole to connect to one end of the connecting assembly, the driving end being capable of driving the connecting assembly to rotate, and another end of the connecting assembly being formed with an insert hole configured for a support column on a bottom of the wine bottle to insert.

19 Claims, 6 Drawing Sheets

WINE BOTTLE HOLDER

CROSS-REFERENCE TO RELATED APPLICATIONS

This application is a Continuation-in-Part of the U.S. application Ser. No. 18/329,843 filed on Jun. 6, 2023, and entitled "WINE BOTTLE HOLDER," now, the entire disclosures of which are incorporated herein by reference.

TECHNICAL FIELD

The present disclosure relates to a wine bottle holder, which is applied to the technical field of wine bottle brackets.

BACKGROUND

People nowadays care more and more about the quality of life and the sense of atmosphere. Therefore, most people often choose to drink wine such as whiskey, vodka, red wine or grape wine when at dates or dinner parties to enhance the atmosphere. At present, wine bottle holders available on the market are merely used for support and exhibition. The design is rigid. The overall holder is of low artistic style and with single function. Furthermore, if the wine bottle is of a dark color and has a label stuck thereon, the remaining amount of wine inside the bottle is not easy to observe, leading to inconvenience in checking the remaining amount of wine.

SUMMARY

In view of the above problems in the existing technologies that wine bottle holders are merely used for support and exhibition, the design is rigid and the overall holder is of low artistic style and with single function, the present disclosure provides a wine bottle holder including a driving device capable of driving a wine bottle placed on a support device to rotate by means of a connecting assembly, whereby improving the artistic style of the overall wine bottle holder and enhancing the sense of atmosphere of drinking when at dates or dinner parties.

The technical solution adopted by the present disclosure to solve the technical problem is as follows.

A wine bottle holder, includes: a support device configured to bear a wine bottle, the support device being formed thereon with a first mounting groove, and the first mounting groove being formed therein with a first through hole communicated with an inside of the support device; a driving device provided with a driving end, the driving device being arranged inside the support device; and a connecting assembly arranged inside the first mounting groove, the driving end of the driving device passing through the first through hole to connect to one end of the connecting assembly, the driving end being capable of driving the connecting assembly to rotate, and another end of the connecting assembly being formed with an insert hole configured for a support column on a bottom of the wine bottle to insert; wherein when the wine bottle is mounted on the support device, the support column on the bottom of the wine bottle is inserted into the insert hole, the driving device is enabled, the driving end drives the connecting assembly to rotate, and the connecting assembly drives the wine bottle to rotate.

Further, the support device includes: a bracket, the first mounting groove being arranged on one end of the bracket, the first through hole being arranged on the bracket, and another end of the bracket being formed with a placement opening configured to hold a bottle neck of the wine bottle; and a support seat formed thereon with a second through hole, the bracket being mounted on the support seat, and the first through hole being arranged corresponding to the second through hole, the driving end of the driving device passing through the second through hole and the first through hole in turn to connect to the connecting assembly.

Further, the connecting assembly includes a first sleeve and a second sleeve; the first sleeve is rotatably mounted inside the first mounting groove; the driving end of the driving device passes through the second through hole and the first through hole in turn to connect to the first sleeve; the second sleeve is mounted inside the first sleeve; the insert hole is arranged on the second sleeve; and when the driving end of the driving device drives the first sleeve, the first sleeve drives the second sleeve.

Further, the first sleeve is made of a plastic material, and the second sleeve is made of a silicone material.

Further, the first sleeve is formed with a snap groove on an inner sidewall thereof, and the second sleeve is provided with a snap protrusion; when the second sleeve is mounted inside the first sleeve, the snap protrusion is snapped into the snap groove; alternatively, the first sleeve is provided with a snap protrusion on an inner sidewall thereof, and the second sleeve is formed with a snap groove on an outer sidewall thereof; when the second sleeve is mounted inside the first sleeve, the snap protrusion is snapped into the snap groove.

Further, one end of the bracket connected to the support seat is provided with a connecting column at an end head thereof, the connecting column has a sidewall fixedly arranged on the end head of the bracket, the first mounting groove is arranged on a top of the connecting column, the first through hole is positioned inside the first mounting groove and extends through a bottom of the connecting column, the connecting column is mounted on the support seat and positioned at the second through hole.

Further, the support seat includes a base and a mounting hood; the mounting hood is formed with an upper opening and a lower opening, wherein one end with the lower opening is arranged on the base; a transverse partition plate is arranged inside the mounting hood; the transverse partition plate separates a space inside the mounting hood into an upper mounting space and a lower mounting space; and the second through hole is arranged on the transverse partition plate; one end of the connecting column formed with the first through hole passes through the upper opening to be snapped into the upper mounting space; and the driving device is mounted inside the lower mounting space.

Further, the mounting hood is arranged in a tapered shape and inclined toward one side.

Further, the bracket is in a concave arc shape.

Further, one end of the bracket is arranged higher than another end of the bracket.

Further, the wine bottle holder further includes a first illumination module, the first illumination module is arranged on the bracket and along the shape of the bracket, and the first illumination module is configured to emit illumination light to irradiate on the wine bottle placed on the bracket.

Further, the curved bracket is formed with a second mounting groove on an inner side thereof, and the first illumination module is arranged inside the second mounting groove.

Further, the wine bottle holder further includes a control circuit board, a first lead wire and a second lead wire; the control circuit board is arranged inside the base; the base is formed thereon with a first wire hole; the transverse partition plate is formed with a first notch on a sidewall thereof; the mounting hood is formed with a second notch on an inner sidewall thereof; the first notch is arranged corresponding to the second notch, and the first notch and the second notch are spliced to form a second wire hole; the connecting column is formed with a third notch on an outer sidewall thereof; a connecting surface of the bracket to the connecting column is formed with a fourth notch; the third notch and the fourth notch are spliced to form a third wire hole; the third wire hole and the second wire hole are spliced; the fourth notch has an inner surface formed thereon with a fourth wire hole; the fourth wire hole is communicated with the second mounting groove; one end of the first lead wire is electrically connected to the control circuit board, while another end of the first lead wire passes through the first wire hole to connect to the driving device; one end of the second lead wire is electrically connected to the control circuit board, while another end of the second lead wire passes through the first wire hole, the second wire hole, the third wire hole and the fourth wire hole in turn to electrically connect to the first illumination module.

Further, the first illumination module includes a lampshade and an illumination device; the illumination device is arranged inside the second mounting groove; and the lampshade covers the second mounting groove.

Further, the lampshade includes a transparent shade plate and mounting side plates arranged on two sides of the transparent shade plate; the transparent shade plate has a bigger width than a distance between the two mounting side plates, and two sides of the transparent shade plate are arranged protruding from the two mounting side plates; the mounting side plates are fixedly connected to the transparent shade plate; and the transparent shade plate covers the second mounting groove.

Further, the lampshade is of a flexible material.

Further, the wine bottle holder further includes an energy storage power supply, the energy storage power supply is arranged inside the base, and the energy storage power supply is electrically connected to the control circuit board.

Further, the base is further provided with a cup placement area configured to place a cup body.

Further, the cup placement area is arranged at two sides of the mounting hood.

Further, a second illumination module is arranged inside the base corresponding to the cup placement area, and the cup placement area is arranged as a transparent area; and the second illumination module is configured to emit light to irradiate on the cup body on the cup placement area.

The present disclosure has the following beneficial effects. The present disclosure provides a wine bottle holder including a driving device capable of driving a wine bottle placed on a support device to rotate by means of a connecting assembly, whereby improving the artistic style of the overall wine bottle holder and enhancing the sense of atmosphere of drinking when at dates or dinner parties. A bracket of the wine bottle holder is further provided with a first illumination module along the shape of the bracket, which is configured to emit illumination light to irradiate on the wine bottle placed on the bracket. When drinking, not only can the remaining amount of wine in the wine bottle placed on the bracket be observed at any time, but the lighting effect also enhances the sense of atmosphere of drinking, increases the versatility of the wine bottle holder and achieves a better user experience. The base is further provided with a second illumination module corresponding to a cup placement area. The light of the second illumination module irradiates on a cup, where not only can the remaining amount of wine in the cup be observed, but the sense of atmosphere of drinking is enhanced, the versatility of the wine bottle holder is increased, and a better user experience is provided.

DETAILED DESCRIPTION OF THE EMBODIMENTS

The present disclosure is further described below in combination with accompanying drawings and implementations. It should be understood that the specific embodiments described herein are intended only to explain the present disclosure and are not intended to define the present disclosure.

Referring to FIG. 1 to FIG. 9, a wine bottle holder provided by the present disclosure includes a support device 1, a driving device 2 and a connecting assembly 3.

Figure 1:
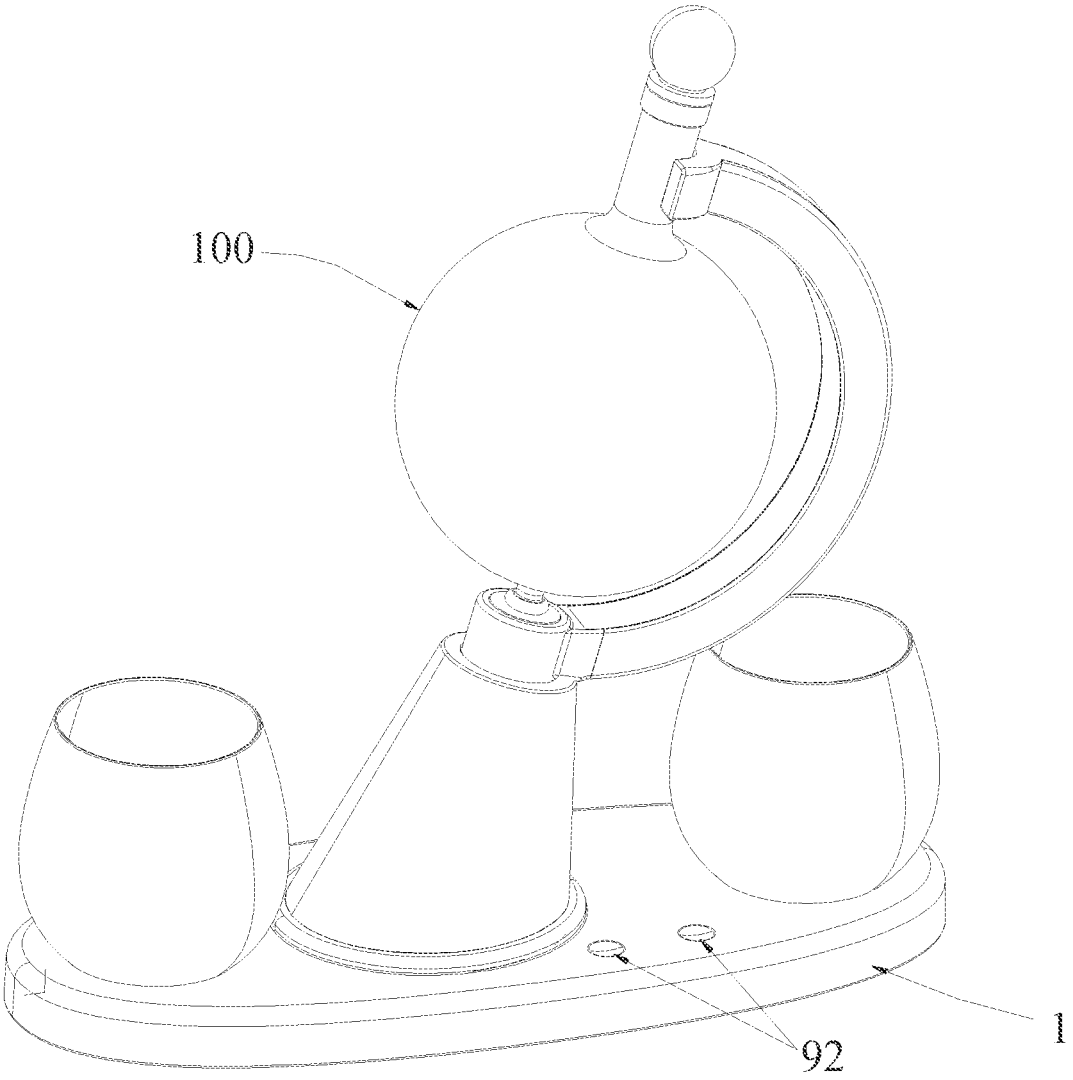
FIG. 1 is a perspective view of a wine bottle holder provided by the present disclosure.
Figure 2:
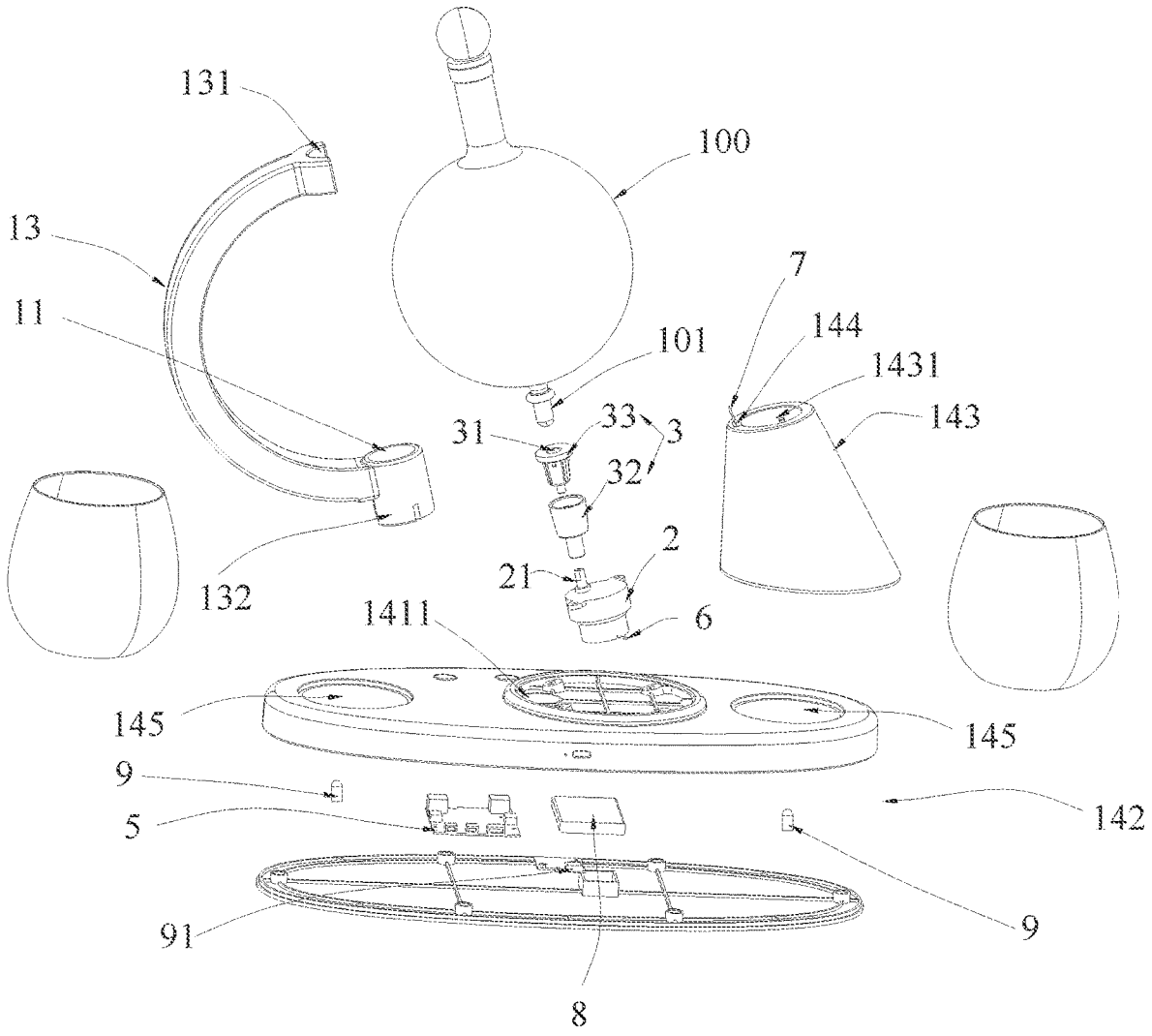
FIG. 2 is an exploded view of a wine bottle holder provided by the present disclosure.

As shown in FIG. 1 to FIG. 2, the above support device 1 is configured to bear a wine bottle 100. The support device 1 is formed thereon with a first mounting groove 11, and the first mounting groove 11 is formed therein with a first through hole 12 communicated with an inside of the support device 1.

As shown in FIG. 2, the above driving device 2 is provided with a driving end 21. The driving device 2 is arranged inside the support device 1. In the present embodiment, the driving device is a motor, which is provided with a driving end. The motor is of existing technologies, whose concrete structure is not described in detail here.

As shown in FIG. 2, the above connecting assembly 3 is arranged inside the first mounting groove 11. The driving end 21 of the driving device 2 passes through the first through hole 12 to connect to one end of the connecting assembly 3. The driving end 21 is capable of driving the connecting assembly 3 to rotate. Another end of the connecting assembly 3 is formed with an insert hole 31 configured for a support column 101 on a bottom of the wine bottle 100 to insert.

Figure 3:
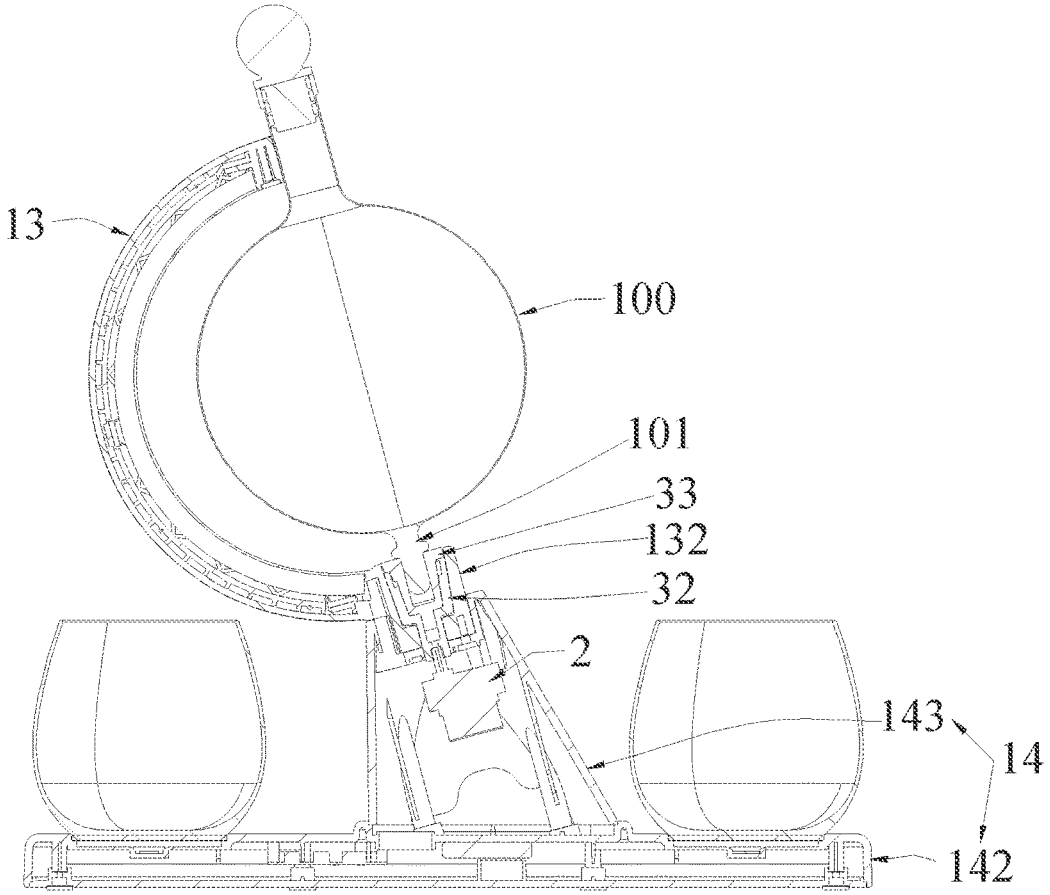
FIG. 3 is a sectional view of a wine bottle holder provided by the present disclosure.

As shown in FIG. 1 to FIG. 3, when the wine bottle 100 is mounted on the support device 1, the support column 101 on the bottom of the wine bottle 100 is inserted into the insert hole 31, the driving device 2 is enabled, the driving end 21 drives the connecting assembly 3 to rotate, and then the connecting assembly 3 drives the wine bottle 100 to rotate.

The above structure overall is to drive the wine bottle arranged on the support device to rotate employing the driving device by means of the connecting assembly, whereby improving the artistic style of the overall wine bottle holder and enhancing the sense of atmosphere of drinking when at dates or dinner parties.

In the present embodiment, as shown in FIG. 1 to FIG. 3, the support device 1 includes a bracket 13 and a support seat 14. The support seat 14 is formed thereon with a second through hole 141. One end of the bracket 13 is mounted on the support seat 14, and the first through hole 12 is arranged corresponding to the second through hole 141. The first mounting groove 11 is arranged on one end of the bracket 13, the first through hole 12 is arranged on the bracket 13, and another end of the bracket 13 is formed with a placement opening 131 configured to hold a bottle neck of the wine bottle 100. The driving end 21 of the driving device passes through the second through hole 141 and the first through hole 12 in turn to connect to the connecting assembly 3. The arrangement of the bracket 13 and the support seat 14 enables a clearer structure, making the wine bottle holder with more sense of design and feel of stereoscopy. That is to say, the bottle neck of the wine bottle is placed at the placement opening 131, the support column 101 on the bottom of the wine bottle 100 is connected to the connecting assembly arranged inside the first mounting groove 11. While the support column is connected to the connecting assembly, when the connecting assembly is rotated, the connecting assembly drives the wine bottle to rotate by means of the support column arranged on the bottom of the wine bottle. That is, the driving device is enabled, the driving end of the driving device drives the connecting assembly to rotate, and the connecting assembly drives the wine bottle to rotate.

Figure 4:
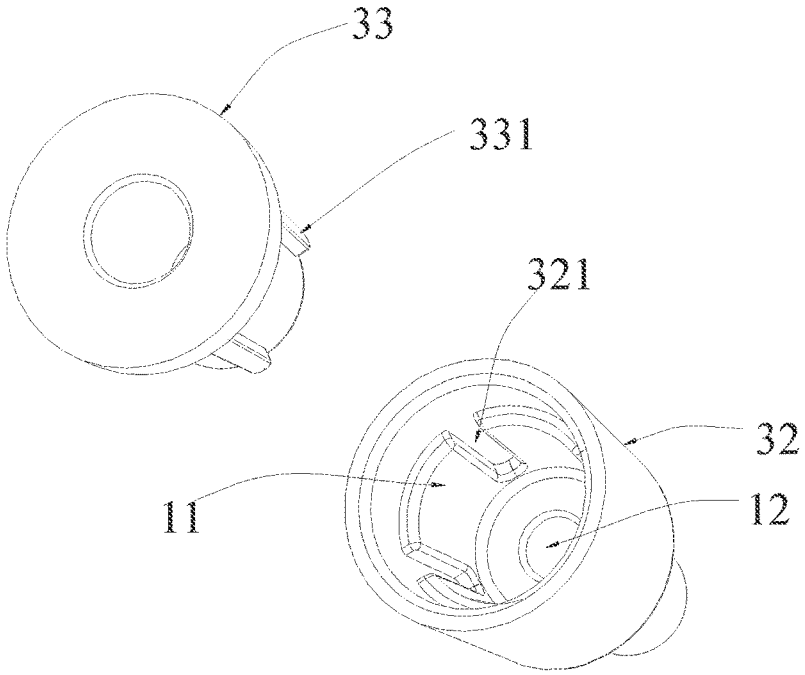
FIG. 4 is a structure diagram of a connecting assembly provided by the present disclosure.

In the present embodiment, as shown in FIG. 2 to FIG. 4, the connecting assembly 3 includes a first sleeve 32 and a second sleeve 33. The first sleeve 32 is rotatably mounted inside the first mounting groove 11, the driving end 21 of the driving device passes through the second through hole 141 and the first through hole 12 in turn to connect to the first sleeve 32, and the second sleeve 33 is mounted inside the first sleeve 32. The insert hole 31 is arranged on the second sleeve 33. When the driving end 21 of the driving device drives the first sleeve 32, the first sleeve 32 drives the second sleeve 33. Such structure is more convenient to assemble, without other small parts to fasten, such as screws, bolts, etc.

In the present embodiment, the first sleeve 32 is made of a plastic material, and the second sleeve 33 is made of a silicone material. The silicone material is an elastic material. When the support column of the wine bottle is mounted inside the second sleeve, the second sleeve can tightly secure around the support column of the wine bottle, needing no arrangement of additional snap-fit structure or other fixing structure, and being more convenient for a user to place and use the wine bottle. The first sleeve 32 is made of a plastic material for easier connection to the driving end of the driving device. The first sleeve directly and tightly secures around the driving end of the driving device with one end, and meanwhile can be tightly fastened inside the first mounting groove 11, uneasy to deform.

In the present embodiment, as shown in FIG. 4, the first sleeve 32 is formed with a snap groove 321 on an inner sidewall thereof, and the second sleeve 33 is provided with a snap protrusion 331. When the second sleeve 33 is mounted inside the first sleeve 32, the snap protrusion 331 is snapped into the snap groove 321. Alternatively, the first sleeve 32 is provided with a snap protrusion 331 on an inner sidewall thereof, and the second sleeve 33 is formed with a snap groove 321 on an outer sidewall thereof. When the second sleeve 33 is mounted inside the first sleeve 32, the snap protrusion 331 is snapped into the snap groove 321. The snap protrusion 331 can be arranged as a hard block, making a more stable snap fit. The snap protrusion 331 is integrally formed with the first sleeve 32 or the second sleeve 33. The snap groove 321 and the snap protrusion 331 are arranged to facilitate convenient assembly, which reduces the usage of parts, and saves cost and assembly time.

Figure 5:
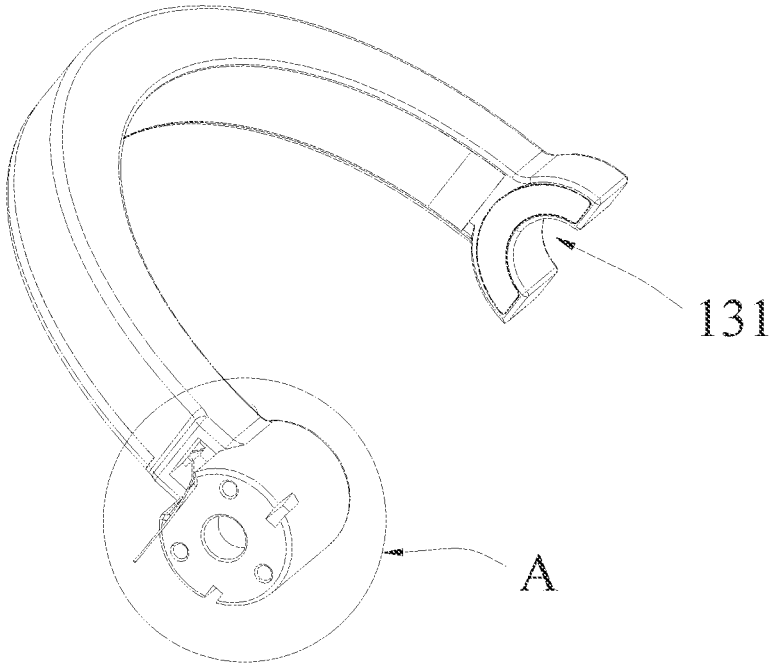
FIG. 5 is a perspective view of a bracket provided by the present disclosure.
Figure 6:
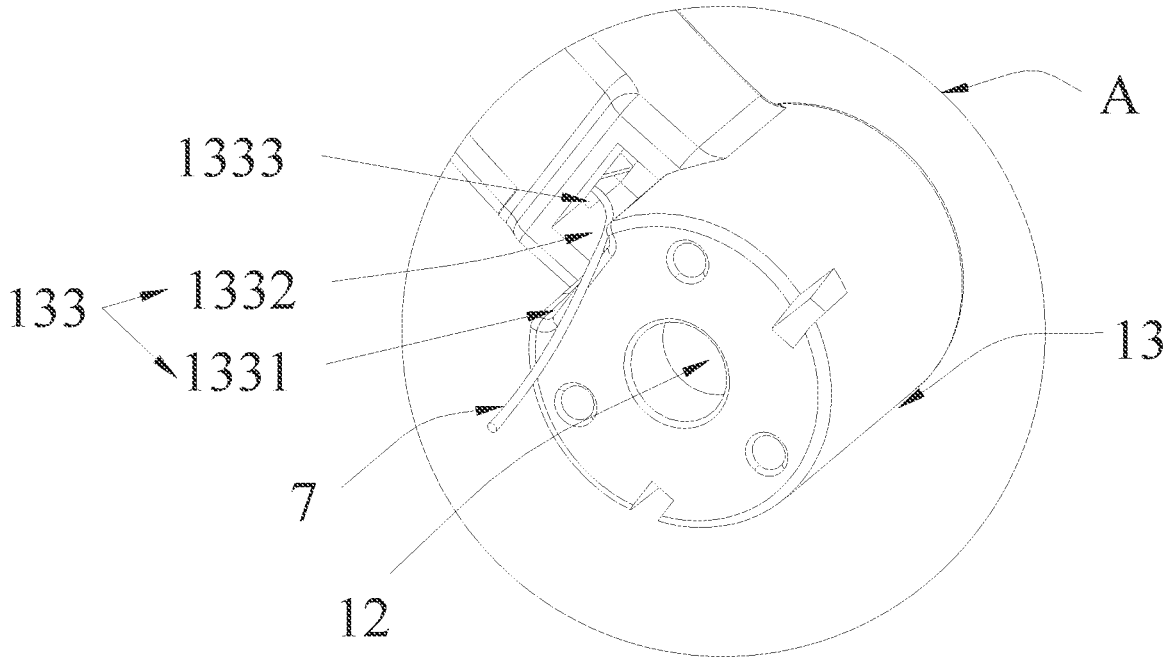
FIG. 6 is an enlargement view of part A provided by the present disclosure.

In the present embodiment, as shown in FIG. 5 to FIG. 6, one end of the bracket 13 connected to the support seat 14 is provided with a connecting column 132 at an end head thereof, the connecting column 132 has a sidewall fixedly arranged on the end head of the bracket 13, the first mounting groove 11 is arranged on a top of the connecting column 132, the first through hole 12 is positioned inside the first mounting groove 11 and extends through a bottom of the connecting column 132, the connecting column 132 is mounted on the support seat 14 and positioned at the second through hole 141. The arrangement of the connecting column 132 makes the assembly easier between the bracket and the support seat. In the present embodiment, the connecting column is integrally formed with the bracket, which is convenient to demold and reduces assembly procedures.

Figure 7:
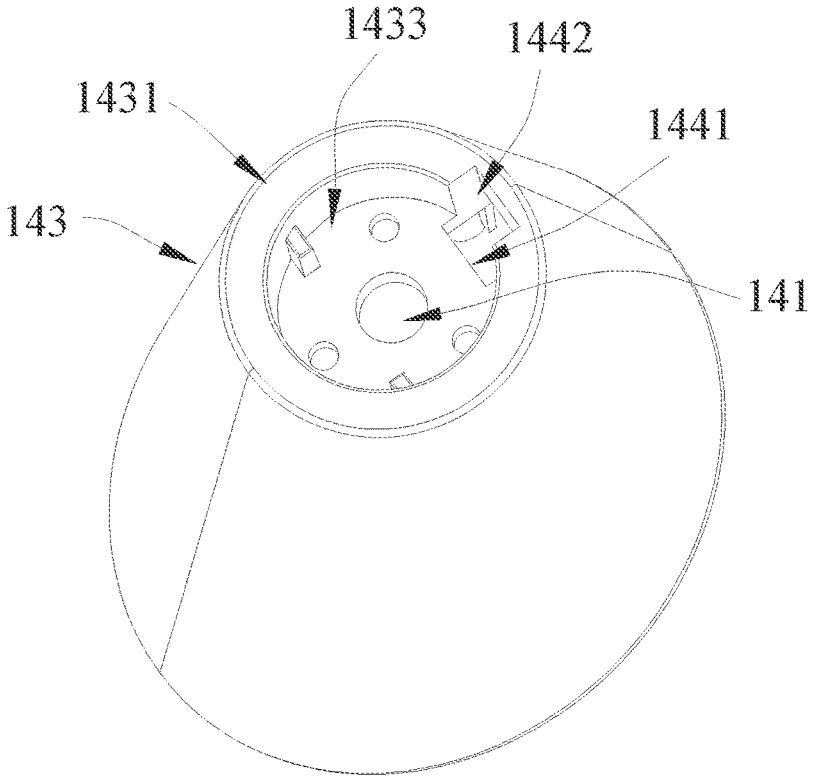
FIG. 7 is a perspective view of a mounting hood provided by the present disclosure.
Figure 8:
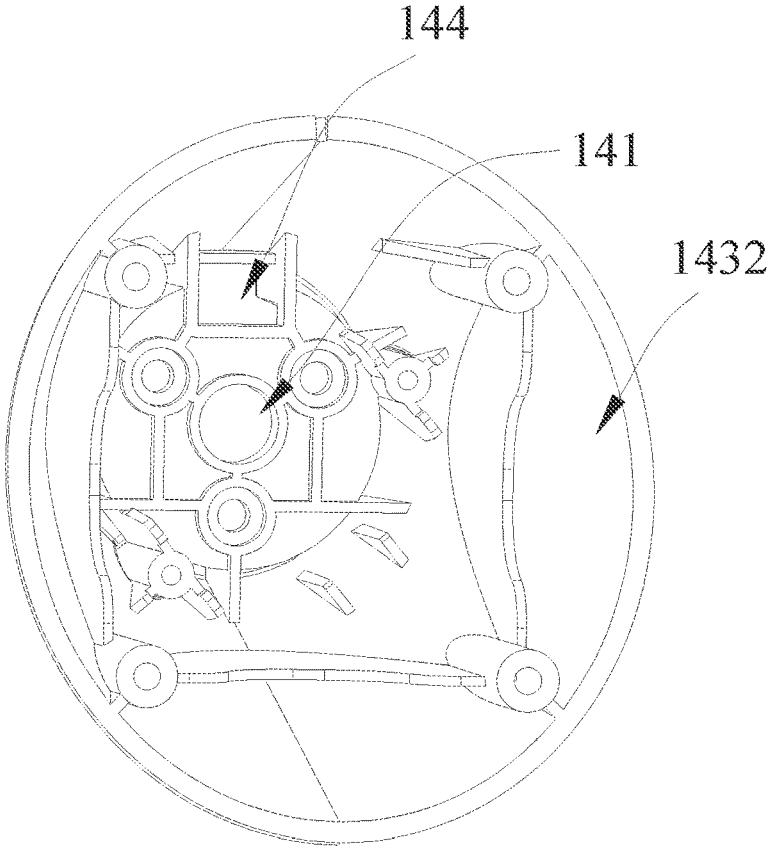
FIG. 8 is a perspective view of a mounting hood provided by the present disclosure.

In the present embodiment, as shown in FIG. 2, FIG. 7 and FIG. 8, the support seat 14 includes a base 142 and a mounting hood 143. The mounting hood 143 is formed with an upper opening 1431 and a lower opening 1432, wherein one end with the lower opening 1432 is arranged on the base 142. A transverse partition plate 1433 is arranged inside the mounting hood 143. The transverse partition plate 1433 separates a space inside the mounting hood 143 into an upper mounting space and a lower mounting space. The second through hole 141 is arranged on the transverse partition plate 1433. One end of the connecting column 132 formed with the first through hole 12 passes through the upper opening 1431 to be snapped into the upper mounting space. The driving device 2 is mounted inside the lower mounting space. The arrangement of the base 142 and the mounting hood 143 makes the wine bottle holder with more feel of stereoscopy, more sense of design, and more sense of art.

In the present embodiment, as shown in FIG. 7, the mounting hood 143 is arranged in a tapered shape and inclined toward one side, which improves the sense of design of the wine bottle holder and makes the overall shape of the wine bottle holder less rigid.

In the present embodiment, the bracket 13 is in a concave arc shape, which can be adapted to the shape of the wine bottle, achieving a better support effect and improving the degree of sensory of appearance.

In the present embodiment, as shown in FIG. 1, one end of the bracket 13 is arranged higher than another end of the bracket 13. A first end head of the curved bracket is higher than a second end head of the curved bracket, making it more convenient to place the wine bottle and achieving a secure support effect, where it is convenient for a user to take and place.

Figure 9:
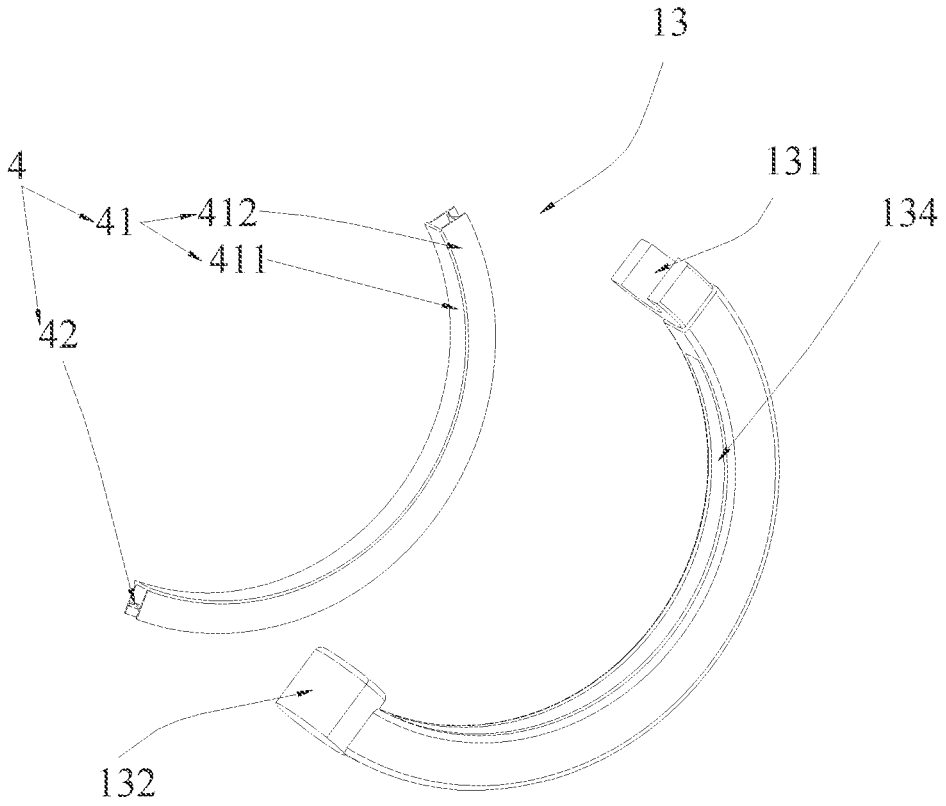
FIG. 9 is a structure diagram of a bracket provided by the present disclosure.

In the present embodiment, as shown in FIG. 9, the wine bottle holder further includes a first illumination module 4. The first illumination module 4 is arranged on the bracket 13 and along the shape of the bracket 13. The first illumination module 4 is configured to emit illumination light to irradiate on the wine bottle 100 placed on the bracket 13. The first illumination module 4 is arranged to occupy the inner curved surface of the curved bracket as much as possible, so that more light can be scattered over the wine bottle or wine decanter more uniformly, making the wine bottle holder in the present embodiment of higher quality feel and higher artistic style when in use. The first illumination module 4 can emit different light, and a user can adjust the lighting effect according to his/her own preference.

In the present embodiment, as shown in FIG. 9, the curved bracket is formed with a second mounting groove 134 on an inner side thereof, and the first illumination module 4 is arranged inside the second mounting groove 134, whereby the first illumination module 4 is easy to mount.

In the present embodiment, as shown in FIG. 2, FIG. 6, FIG. 7 and FIG. 8, the wine bottle holder further includes a control circuit board 5, a first lead wire 6 and a second lead wire 7. The control circuit board 5 is arranged inside the base 142. The base 142 is formed thereon with a first wire hole 1411. The transverse partition plate 1433 is formed with a first notch 1441 on a sidewall thereof. The mounting hood 143 is formed with a second notch 1442 on an inner sidewall thereof. The first notch 1441 is arranged corresponding to the second notch 1442, and the first notch 1441 and the second notch 1442 form a second wire hole 144. The connecting column 132 is formed with a third notch 1331 on an outer sidewall thereof. A connecting surface of the bracket 13 to the connecting column 132 is formed with a fourth notch 1332. The third notch 1331 and the fourth notch 1332 are spliced to form a third wire hole 133. The third wire hole 133 and the second wire hole 144 are spliced. The fourth notch 1332 has an inner surface formed thereon with a fourth wire hole 1333. The fourth wire hole 1333 is communicated with the second mounting groove 134. One end of the first lead wire 6 is electrically connected to the control circuit board 5, while another end of the first lead wire 6 passes through the first wire hole 1411 to connect to the driving device. One end of the second lead wire 7 is electrically connected to the control circuit board 5, while another end of the second lead wire 7 passes through the first wire hole 1411, the second wire hole 144, the third wire hole 133 and the fourth wire hole 1333 in turn to electrically connect to the first illumination module 4. In the present embodiment, the first wire hole 1411, the second wire hole 144, the third wire hole 133 and the fourth wire hole 1333 are arranged to facilitate the orderly routing of the second lead wire 7.

In the present embodiment, as shown in FIG. 9, the first illumination module 4 includes a lampshade 41 and an illumination device 42. The illumination device 42 is arranged between the second mounting groove 134 and the lampshade 41. The lampshade 41 covers the second mounting groove 134. In the present embodiment, the lampshade 41 includes a transparent shade plate 411 and mounting side plates 412 arranged on two sides of the transparent shade plate 411. The transparent shade plate 411 has a bigger width than a distance between the two mounting side plates 412, and two sides of the transparent shade plate 411 are arranged protruding from the two mounting side plates 412. The mounting side plates 412 are fixedly connected to the transparent shade plate 411, and the transparent shade plate 411 covers the second mounting groove 134. In the present embodiment, the lampshade 41 is of a flexible material. The flexible material can facilitate assembly with the bracket. The illumination device 42 may be an LED lamp or a lamp strip. If an LED lamp is to be arranged, a plurality of the LED lamps is arranged that are evenly distributed inside the first mounting groove, so that the light can be scattered over the wine bottle as uniformly as possible. If a lamp strip is to be arranged, it may be fixedly arranged between the two side plates.

In the present embodiment, as shown in FIG. 2, the wine bottle holder further includes an energy storage power supply 8. The energy storage power supply 8 is arranged inside the base 142. The energy storage power supply 8 is electrically connected to the control circuit board 5. With the energy storage power supply 8, no wire connection is needed, making it more convenient for a user to use.

In the present embodiment, as shown in FIG. 2, the base 142 is further provided with a cup placement area 145 configured to place a cup body. The cup placement area 145 is added so that the wine bottle holder is more convenient to use, which not only can place a cup, but also can place a wine decanter or a red wine bottle, achieving multiple functions and improving the user experience. In the present embodiment, multiple cup placement areas 145 may be arranged, preferably two cup placement areas 145 are arranged.

In the present embodiment, as shown in FIG. 1 to FIG. 2, the cup placement areas 145 are arranged at two sides of the mounting hood 143.

In the present embodiment, a recess is formed at the cup placement area 145. The recess is configured to place a cup, whereby the cup can be placed more stably.

In the present embodiment, as shown in FIG. 2, a second illumination module 9 is arranged inside the base 142 corresponding to the cup placement area 145, and the cup placement area 145 is arranged as a transparent area. The second illumination module 9 is configured to emit light to irradiate on the cup body on the cup placement area 145. The arrangement of the second illumination module makes the wine bottle holder of higher artistic style and enhances the sense of atmosphere of drinking. In the present embodiment, the second illumination module may be an LED lamp.

In the present embodiment, as shown in FIG. 1, the wine bottle holder further includes a light control button 92. The light control button 92 is arranged on the base 142 and is configured to control the first illumination module 4 and the second illumination module 9. The light control button 92 is arranged as a metal button. The first illumination module 4 and/or the second illumination module 9 have/has multiple illumination modes of different colors. The light control button 92 is configured to generate a control signal based on a user operation and transmit the control signal to the control circuit board 5, so that the control circuit board 5 controls the illumination mode of the first illumination module 4 and/or the second illumination module 9. A user may select light according to the atmosphere. The number of the light control modes may be set to be greater than or equal to 10. For example, when the light control button 92 is pressed once, it is white light, twice the red light, three times the orange light, four times the purple light, five times the yellow light, and so on. Each time of pressing results in a different color of light. If the light is turned off when the light control button 92 is pressed ten times, then a new cycle can start with the white light. In this way, the user has more light modes to select to adjust the atmosphere. However, the lighting effect is not limited thereto. It can also be that upon the light control button 92 is pressed, other lighting effects can be presented, such as flickering of different colors of light. Wherever the wine bottle bolder is placed, the lighting effect may be used to enhance the atmosphere. If not in use, it can still serve as a table lamp.

In the present embodiment, as shown in FIG. 2, the base is further provided with a charging interface 91.

Overall, the wine bottle holder in the present embodiment can drive a wine bottle placed on the bracket to rotate by means of the driving device. Furthermore, there is provided a light irradiation corresponding to the wine bottle and a light irradiation corresponding to the cup body, which can enhance the sense of atmosphere of drinking and achieve a higher artistic style. The remaining amount of wine in the wine bottle can be observed at any time. In addition, the bracket is arranged in a curved shape, making the wine bottle holder with higher sense of design and less sense of rigidness, hence improving the user experience.

It should be understood that, the present disclosure is not limited to the specific embodiments here, and various significant changes, readjustments, and substitutions that can be made by those skilled in the art will not depart from the protection scope of the present disclosure.

The invention claimed is:

1. A wine bottle holder, comprising:

a support device configured to bear a wine bottle, the support device being formed thereon with a first mounting groove, and the first mounting groove being formed therein with a first through hole communicated with an inside of the support device;

a driving device provided with a driving end, the driving device being arranged inside the support device; and a connecting assembly arranged inside the first mounting groove, the driving end of the driving device passing through the first through hole to connect to one end of the connecting assembly, the driving end being capable of driving the connecting assembly to rotate, and another end of the connecting assembly being formed with an insert hole configured for a support column on a bottom of the wine bottle to insert; wherein when the wine bottle is mounted on the support device, the support column on the bottom of the wine bottle is inserted into the insert hole, the driving device is enabled, the driving end drives the connecting assembly to rotate, and the connecting assembly drives the wine bottle to rotate, wherein the support device comprises:

a bracket, the first mounting groove being arranged on one end of the bracket, the first through hole being arranged on the bracket, and another end of the bracket being formed with a placement opening configured to hold a bottle neck of the wine bottle; and a support seat formed thereon with a second through hole, the bracket being mounted on the support seat, and the first through hole being arranged corresponding to the second through hole, the driving end of the driving device passing through the second through hole and the first through hole in turn to connect to the connecting assembly.

2. The wine bottle holder according to claim 1, wherein the connecting assembly comprises a first sleeve and a second sleeve; the first sleeve is rotatably mounted inside the first mounting groove; the driving end of the driving device passes through the second through hole and the first through hole in turn to connect to the first sleeve; the second sleeve is mounted inside the first sleeve; the insert hole is arranged on the second sleeve; and when the driving end of the driving device drives the first sleeve, the first sleeve drives the second sleeve.

3. The wine bottle holder according to claim 2, wherein the first sleeve is made of a plastic material, and the second sleeve is made of a silicone material.

4. The wine bottle holder according to claim 2, wherein the first sleeve is formed with a snap groove on an inner sidewall thereof, and the second sleeve is provided with a snap protrusion; when the second sleeve is mounted inside the first sleeve, the snap protrusion is snapped into the snap groove; alternatively, the first sleeve is provided with a snap protrusion on an inner sidewall thereof, and the second sleeve is formed with a snap groove on an outer sidewall thereof; when the second sleeve is mounted inside the first sleeve, the snap protrusion is snapped into the snap groove.

5. The wine bottle holder according to claim 2, wherein one end of the bracket connected to the support seat is provided with a connecting column at an end head thereof, the connecting column has a sidewall fixedly arranged on the end head of the bracket, the first mounting groove is arranged on a top of the connecting column, the first through hole is positioned inside the first mounting groove and extends through a bottom of the connecting column, the connecting column is mounted on the support seat and positioned at the second through hole.

6. The wine bottle holder according to claim 5, wherein the support seat comprises a base and a mounting hood; the mounting hood is formed with an upper opening and a lower opening, wherein one end with the lower opening is arranged on the base; a transverse partition plate is arranged inside the mounting hood; the transverse partition plate separates a space inside the mounting hood into an upper mounting space and a lower mounting space; and the second through hole is arranged on the transverse partition plate; one end of the connecting column formed with the first through hole passes through the upper opening to be snapped into the upper mounting space; and the driving device is mounted inside the lower mounting space.

7. The wine bottle holder according to claim 6, wherein the mounting hood is arranged in a tapered shape and inclined toward one side.

8. The wine bottle holder according to claim 6, wherein the bracket is in a concave arc shape.

9. The wine bottle holder according to claim 8, wherein one end of the bracket is arranged higher than another end of the bracket.

10. The wine bottle holder according to claim 8, wherein the wine bottle holder further comprises a first illumination module, the first illumination module is arranged on the bracket and along the shape of the bracket, and the first illumination module is configured to emit illumination light to irradiate on the wine bottle placed on the bracket.

11. The wine bottle holder according to claim 10, wherein the curved bracket is formed with a second mounting groove on an inner side thereof, and the first illumination module is arranged inside the second mounting groove.

12. The wine bottle holder according to claim 11, wherein the wine bottle holder further comprises a control circuit board, a first lead wire and a second lead wire; the control circuit board is arranged inside the base; the base is formed thereon with a first wire hole; the transverse partition plate is formed with a first notch on a sidewall thereof; the mounting hood is formed with a second notch on an inner sidewall thereof; the first notch is arranged corresponding to the second notch, and the first notch and the second notch are spliced to form a second wire hole; the connecting column is formed with a third notch on an outer sidewall thereof; a connecting surface of the bracket to the connecting column is formed with a fourth notch; the third notch and the fourth notch are spliced to form a third wire hole; the third wire hole and the second wire hole are spliced; the fourth notch has an inner surface formed thereon with a fourth wire hole;

the fourth wire hole is communicated with the second mounting groove; one end of the first lead wire is electrically connected to the control circuit board, while another end of the first lead wire passes through the first wire hole to connect to the driving device; one end of the second lead wire is electrically connected to the control circuit board, while another end of the second lead wire passes through the first wire hole, the second wire hole, the third wire hole and the fourth wire hole in turn to electrically connect to the first illumination module.

13. The wine bottle holder according to claim 10, wherein the first illumination module comprises a lampshade and an illumination device; the illumination device is arranged inside the second mounting groove; and the lampshade covers the second mounting groove.

14. The wine bottle holder according to claim 13, wherein the lampshade comprises a transparent shade plate and mounting side plates arranged on two sides of the transparent shade plate; the transparent shade plate has a bigger width than a distance between the two mounting side plates, and two sides of the transparent shade plate are arranged protruding from the two mounting side plates; the mounting side plates are fixedly connected to the transparent shade plate; and the transparent shade plate covers the second mounting groove.

15. The wine bottle holder according to claim 14, wherein the lampshade is of a flexible material.

16. The wine bottle holder according to claim 12, wherein the wine bottle holder further comprises an energy storage power supply, the energy storage power supply is arranged inside the base, and the energy storage power supply is electrically connected to the control circuit board.

17. The wine bottle holder according to claim 6, wherein the base is further provided with a cup placement area configured to place a cup body.

18. The wine bottle holder according to claim 17, wherein the cup placement area is arranged at two sides of the mounting hood.

19. The wine bottle holder according to claim 17, wherein a second illumination module is arranged inside the base corresponding to the cup placement area, and the cup placement area is arranged as a transparent area; and the second illumination module is configured to emit light to irradiate on the cup body on the cup placement area.

* * * * *